US010350144B2

(12) United States Patent
Bomhoff

(10) Patent No.: US 10,350,144 B2
(45) Date of Patent: Jul. 16, 2019

(54) MEDICINE BOTTLE TIMER LID

(71) Applicant: John Bomhoff, Oviedo, FL (US)

(72) Inventor: John Bomhoff, Oviedo, FL (US)

( * ) Notice: Subject to any disclaimer, the term of this patent is extended or adjusted under 35 U.S.C. 154(b) by 0 days.

(21) Appl. No.: 15/371,728

(22) Filed: Dec. 7, 2016

(65) Prior Publication Data

US 2017/0239146 A1 Aug. 24, 2017

Related U.S. Application Data

(60) Provisional application No. 62/298,212, filed on Feb. 22, 2016.

(51) Int. Cl.

| | |
|---|---|
| ***A61J 7/04*** | (2006.01) |
| ***G04F 1/00*** | (2006.01) |
| ***A61J 7/00*** | (2006.01) |
| *G04F 10/00* | (2006.01) |
| *A61J 1/14* | (2006.01) |

(52) U.S. Cl.

CPC ..... *A61J 7/0472* (2013.01); *A61J 7/0076* (2013.01); *G04F 1/00* (2013.01); *G04F 1/005* (2013.01); *A61J 1/1418* (2015.05); *G04F 10/00* (2013.01)

(58) Field of Classification Search

CPC ..... G04F 1/00; G04F 1/005; A61J 7/0472
See application file for complete search history.

(56) References Cited

U.S. PATENT DOCUMENTS

| | | | | |
|---|---|---|---|---|
| 4,419,016 | A * | 12/1983 | Zoltan | A61J 7/0481 206/534 |
| 4,939,705 | A * | 7/1990 | Hamilton | A61J 7/0436 221/2 |
| 5,233,571 | A * | 8/1993 | Wirtschafter | A61J 7/0472 368/10 |
| 5,751,661 | A | 5/1998 | Walters | |
| 6,324,123 | B1 | 11/2001 | Durso | |
| 6,667,936 | B1 * | 12/2003 | Ditzig | A61J 7/0409 368/10 |
| 7,081,807 | B2 | 7/2006 | Lai | |
| 7,236,428 | B1 | 6/2007 | Morse | |
| 7,907,477 | B2 | 3/2011 | Puzia | |
| 2002/0126585 | A1 * | 9/2002 | Osberg | A61J 7/0472 368/107 |
| 2003/0151499 | A1 * | 8/2003 | Huang | A61J 7/0472 340/309.16 |
| 2003/0198134 | A1 * | 10/2003 | Hildebrandt | A61J 7/0481 368/10 |
| 2005/0151625 | A1 * | 7/2005 | Lai | G08B 21/24 340/309.16 |

(Continued)

*Primary Examiner* — Daniel P Wicklund
(74) *Attorney, Agent, or Firm* — Global Intellectual Property Agency, LLC; Daniel Boudwin

(57) ABSTRACT

A medicine bottle timer lid. The medicine bottle timer lid includes a housing removably securable to a medicine bottle having a display operably connected to a timer. The housing further includes a battery and a sensor disposed therein. The sensor is configured to detect the position of the housing with respect to the medicine bottle. The timer is configured to begin counting when the housing is secured to the medicine bottle, and the display shows the amount of time that has elapsed since the housing was secured to the medicine bottle. The timer is further configured to reset upon removal of the housing from the medicine bottle. The medicine bottle timer lid allows individuals to automatically keep track of their medication.

6 Claims, 3 Drawing Sheets

(56) References Cited

U.S. PATENT DOCUMENTS

| | | | | |
|---|---|---|---|---|
| 2008/0117719 | A1* | 5/2008 | Hildebrandt | A61J 7/0472 368/10 |
| 2009/0052283 | A1* | 2/2009 | Puzia | A61J 7/0472 368/10 |
| 2009/0200327 | A1* | 8/2009 | Jurkovich | A61J 7/0409 221/3 |
| 2009/0222130 | A1* | 9/2009 | Morse | A61J 7/0472 700/225 |
| 2012/0223045 | A1* | 9/2012 | Burke, Jr. | A61J 7/0472 215/228 |
| 2012/0224458 | A1* | 9/2012 | Burke, Jr. | G04F 8/08 368/10 |
| 2012/0257478 | A1 | 10/2012 | Marcellino | |

* cited by examiner

MEDICINE BOTTLE TIMER LID

CROSS REFERENCE TO RELATED APPLICATIONS

This application claims the benefit of U.S. Provisional Application No. 62/298,212 filed on Feb. 22, 2016. The above identified patent application is herein incorporated by reference in its entirety to provide continuity of disclosure.

FIELD OF THE INVENTION

The present invention relates to medicine bottle lids. More specifically, the present invention provides a medicine bottle lid having a timer that displays the amount of time that has passed since the lid was removed from a medicine bottle.

BACKGROUND OF THE INVENTION

Many individuals take prescription medication in the form of a pill, which is typically stored in a medicine bottle. In particular, elderly individuals frequently have to take many different medications, often at different times throughout the day. It can be exceedingly difficult for an individual to keep track of their medication schedule, especially if the individual has difficulty with short term memory. Often, an individual may think they took a particular pill when they did not, and miss taking a potentially important medication. Likewise, the individual will forget they took a pill and take another, which may cause harm to the individual. It is therefore desirable to provide a device that assists individuals with tracking their medication consumption.

Devices exist in the known art that are designed to assist individuals in remembering their medication schedule. Pill organizers allow individuals to put certain pills in separate compartments marked with the day that the pill should be taken. However, these pill organizers can be difficult to manage, and they do not provide a means for determining whether or not a pill has already been taken, or what time the pill has been taken.

In light of the devices disclosed in the known art, it is submitted that the present invention substantially diverges in design elements from the known art and consequently it is clear that there is a need in the art for an improvement to existing medicine reminder devices. In this regard the present invention substantially fulfills these needs.

SUMMARY OF THE INVENTION

In view of the foregoing disadvantages inherent in the known types of medicine bottle timers now present in the prior art, the present invention provides a medicine bottle timer lid wherein the same can be utilized for providing convenience for the user when keeping track of a medication schedule. The medicine bottle timer lid includes a housing removably securable to a medicine bottle, the housing having a closed upper end and a circumferential lip defining an open lower end. A display is disposed within an aperture on the closed upper end of the housing, and a timer is operably connected to the display. The medicine bottle timer lid further includes a sensor configured to detect the position of the housing with respect to the medicine bottle, and a battery configured to provide power to the sensor, the timer, and the display. A liner having a circumferential edge that contacts an inner surface of the circumferential lip of the housing encloses the battery, the sensor, and the timer between itself and the open lower end of the housing. The timer is configured to begin counting when the sensor detects contact between the housing and the medicine bottle, and is further configured to reset upon separation of the housing from the medicine bottle. The display is configured to display the amount of time that has elapsed since the housing was secured to the medicine bottle, which notifies individuals the amount of time that has passed since they last took their medication.

One object of the present invention is to provide a medicine bottle timer lid that assists individuals in keeping track of their medication schedule.

Another object of the present invention is to provide a medicine bottle timer lid that is securable to any conventional medicine bottle.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
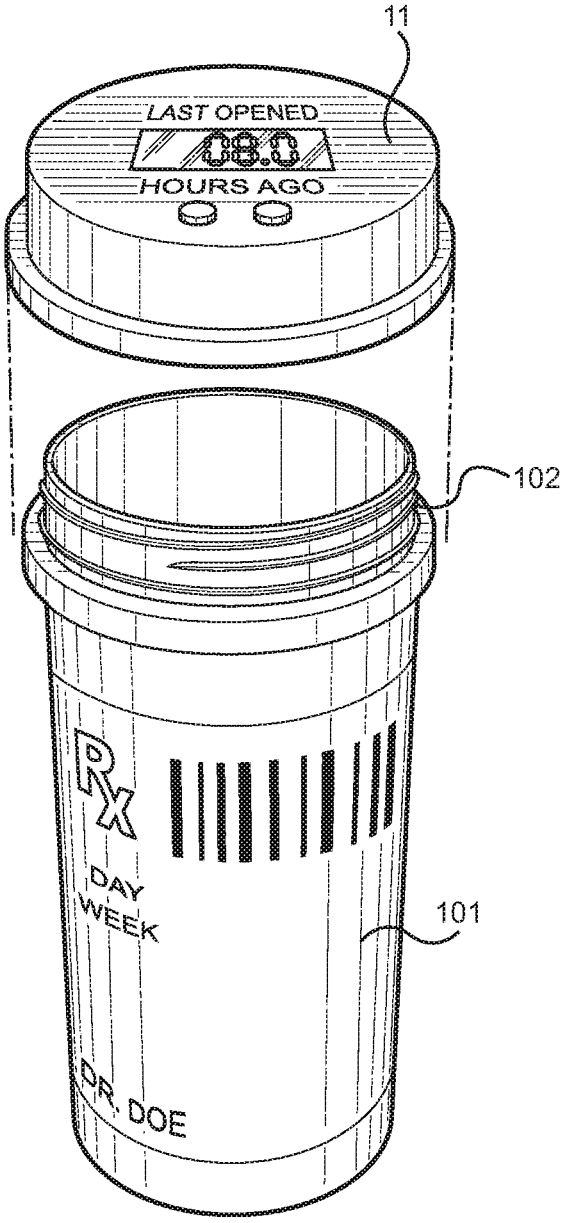
FIG. 1 shows a perspective view of a medicine bottle timer lid according to the present invention.

Reference is made herein to the attached drawings. Like reference numerals are used throughout the drawings to depict like or similar elements of the medicine bottle timer lid. For the purposes of presenting a brief and clear description of the present invention, the preferred embodiment will be discussed as used for tracking and displaying elapsed time since the last opening of a medicine bottle. The figures are intended for representative purposes only and should not be considered to be limiting in any respect.

Referring now to FIG. 1, there is shown a perspective view of a medicine bottle timer lid according to the present invention. The medicine bottle timer lid 11 is removably securable to a medicine bottle 101. The medicine bottle timer lid 11 engages an upper edge 102 of the medicine bottle. In the illustrated embodiment, the medicine bottle timer lid 11 engages the upper edge 102 via a threaded connection. In an alternate embodiment, the medicine bottle timer lid 11 engages with the bottle via a snap or friction fit. In yet another embodiment, the medicine bottle timer lid 11 can include a child safety feature such that downward pressure is required to release the lid from the bottle.

Figure 2:
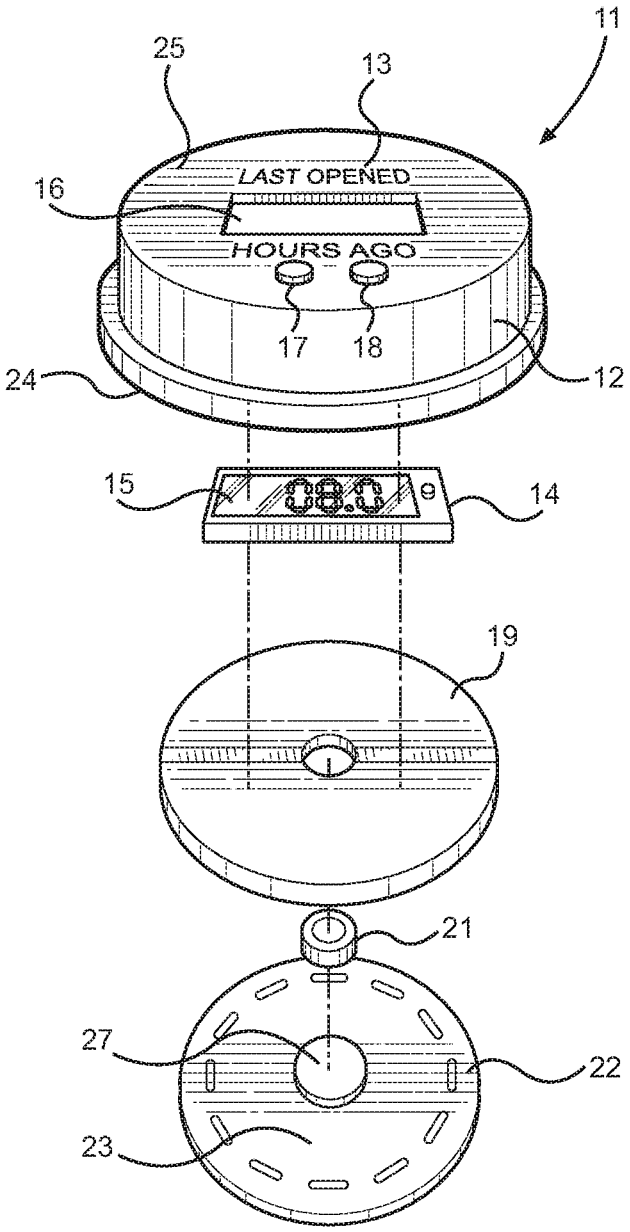
FIG. 2 shows an upper exploded view of a medicine bottle timer lid according to the present invention.
Figure 3:
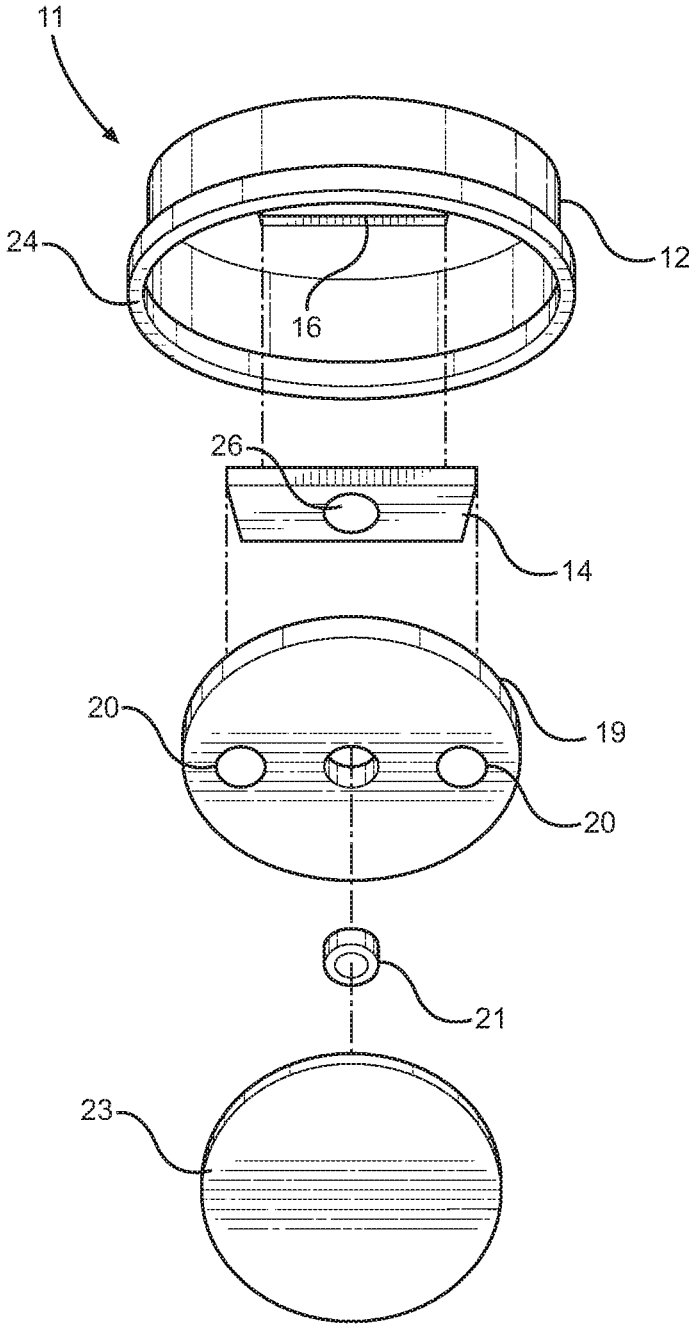
FIG. 3 shows a lower exploded view of a medicine bottle timer lid according to the present invention.

Referring now to FIGS. 2 and 3, there are shown an upper exploded view (FIG. 2) and a lower exploded view (FIG. 3) of a medicine bottle timer lid according to the present invention. The medicine bottle timer lid 11 comprises a housing 12 having a closed upper end 25 and a circumferential lip 24 extending downward therefrom. In one embodiment, an inner surface of the circumferential lip 24 may include threading thereon for engagement with a threaded medicine bottle. In alternate embodiments, the inner surface of the circumferential lip 24 is smooth so as to engage a medicine bottle via a snap or friction fit.

The medicine bottle timer lid 11 further comprises a display 15 operably connected to a timer 14, and the timer 14 includes a battery contact 26 on a lower portion thereof. The display 15 is disposed within an aperture 16 on the closed upper end 25 of the housing 12. The display 15 is preferably disposed within the aperture 16 such that the display 15 is flush with the upper end 25 of the housing 12. The medicine bottle timer lid further includes a sensor 19 that is operably connected to the timer 14. A battery 21 is included for powering the sensor 19, the timer 14, and the display 15. A liner 23 encloses the battery 21, the sensor 19, and the timer 14 against a lower end of the housing 12. Preferably, the battery 21 is disposed between the sensor 19 and the liner 23. The liner 23 includes a battery contact 27, and a circumferential edge 22 that contacts an inner surface of the circumferential lip 24 of the housing 12. In various embodiments, the liner comprises a pressure-sensitive material.

In the illustrated embodiment, the sensor 19 includes a pair of pressure contacts 20. When the housing 12 is engaged with a medicine bottle, the circumferential lip 22 of the liner 23 is compressed toward the housing 12. This completes a circuit and allows electrical energy stored in the battery 21 to power the timer 14 when the housing is engaged with the medicine bottle, thereby measuring the amount of time which the housing 12 remains secured to the medicine bottle. When the housing 12 is removed from the bottle, the liner 23 no longer completes the circuit, and the timer 14 is reset. In various embodiments, the electrical circuit comprises the battery 21, the liner 23, one or more pressure contacts of the pair of pressure contacts 20, and the timer 14.

The closed upper end 25 may include indicia 13 thereon indicating that the display 15 shows the amount of time that has elapsed. The indicia 13 serves to notify users of the exact function of the medicine bottle timer lid 11. Additionally, the timer 14 may be configured to measure time in hours, minutes, or seconds. In a default setting, the display 15 is configured to display the amount of time that has elapsed since the medicine bottle timer lid 11 has been secured to a medicine bottle.

In the illustrated embodiment, the housing 12 further comprises a control 17. The control 17 may include one or more buttons and is operably connected to the timer 14. The control 17 allows users to change the operation of the timer 14 such that the timer counts down a specified amount of time. This enables users to customize the amount of time shown on the medicine bottle timer lid 11 in order to notify themselves of an exact time to take their medicine.

The medicine bottle timer lid 11 may further include an alarm 18 for notifying individuals when it is time to take their medication. The alarm 18 is configured to sound upon the timer 14 reaching a specific time. The control 17 can also be operably connected to the alarm 18 and may be used to control whether or not the alarm 18 sounds upon the timer 14 counting down a specific amount of time. In this way, an alternate use for the medicine bottle timer lid 11 is provided, whereby the timer counts down a user specified time rather than counting down from the time the housing 12 is secured to the medicine bottle.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A medicine bottle timer lid, comprising:

a housing removably securable to a medicine bottle, the housing having a closed upper end with an aperture thereon, and a circumferential lip extending downward from the closed upper end;

a display disposed within the aperture on the closed upper end of the housing;

a timer operably connected to the display;

an audible alarm mechanism operably connected to the timer;

a pressure contact operably connected to the timer, wherein if the housing is removably secured to the medicine bottle, a liner completes an electrical circuit to deliver electricity from a battery to the timer, wherein the electrical circuit comprises the battery, the liner, the pressure contact, and the timer;

wherein the liner includes a circumferential edge that contacts an inner surface of the circumferential lip of the housing, wherein the battery, the pressure contact, and the timer are enclosed between the liner and the closed upper end of the housing, wherein the liner comprises a pressure-sensitive material that is configured to complete the electrical circuit;

a control disposed on an upper surface of the housing, wherein the control is operably connected to the timer, wherein the control is configured to enable selection between a first timer operation mode and a second timer operation mode;

wherein if the timer is in the first timer operation mode, the timer is configured to reset upon separation of the housing from the medicine bottle, wherein the timer is configured to begin counting when the liner initially completes the electrical circuit;

wherein if the timer is in the second timer operation mode, the timer is configured to receive an amount of time via an input from the control, wherein the audible alarm mechanism sounds after the amount of time has passed.

2. The medicine bottle timer lid of claim 1, wherein an upper surface of the display is flush with the upper surface of the housing.

3. The medicine bottle timer lid of claim 1, wherein the display is configured to display a lapsed amount of time that has passed since the housing was last removed from the medicine bottle.

4. The medicine bottle timer lid of claim 1, wherein the circumferential lip of the housing engages the medicine bottle via a friction fit.

5. The medicine bottle timer lid of claim 1, wherein the circumferential lip of the housing engages the medicine bottle via a threaded connection.

6. The medicine bottle timer lid of claim 1, wherein the battery is disposed between the pressure contact and the liner.

* * * * *